United States Patent [19]

Romer et al.

[11] Patent Number: 4,577,813

[45] Date of Patent: Mar. 25, 1986

[54] DISCUS-SHAPED PROJECTILE

[75] Inventors: Rudolf Romer, Kaarst; Manfred Moll, Düsseldorf, both of Fed. Rep. of Germany

[73] Assignee: Rheinmetall GmbH, Dusseldorf, Fed. Rep. of Germany

[21] Appl. No.: 153,921

[22] Filed: May 5, 1980

[30] Foreign Application Priority Data

May 7, 1979 [DE] Fed. Rep. of Germany ..... 2918129

[51] Int. Cl.[4] ..... F42B 13/24

[52] U.S. Cl. ..... 244/3.23; 102/476

[58] Field of Search ..... 244/3.23; 102/483, 501, 102/475, 476; 42/1 F

[56] References Cited

U.S. PATENT DOCUMENTS

| | | | |
|---|---|---|---|
| 3,245,350 | 4/1966 | Kelly | 42/1 F |
| 3,646,888 | 3/1972 | Posson et al. | 89/1 R |
| 3,896,732 | 7/1975 | Schaffer | 102/436 |

*Primary Examiner*—Harold J. Tudor

*Attorney, Agent, or Firm*—Karl F. Ross; Herbert Dubno

[57] ABSTRACT

A weapons system, especially for foot attack upon armored vehicles, has a recoilless firing tube and a discus-shaped projectile. The projectile is provided with a fork having an upper arm and a lower arm and a stabilizer connected to the fork and including a tube having a longitudinal axis and fins at the opposite end. An explosive charge is carried by a hub of the fork and a disk-shaped body is rotatable about the hub between the arms of the fork by a portion of propellant gases to stabilize the projectile along its flight toward a target.

10 Claims, 4 Drawing Figures

DISCUS-SHAPED PROJECTILE

FIELD OF THE INVENTION

Our present invention relates to a discus-shaped projectile of the type in which a discus-shaped body has imparted thereto a rotation about its polar axis transverse to the firing and acceleration axis and impacts against the target or confronts the target in a direction perpendicular to its polar axis. More particularly, the invention relates to a discus-shaped projectile particularly suitable for hand-held firing from the barrel of a bazooka-type antitank weapon for armored-vehicle targets.

BACKGROUND OF THE INVENTION

Disk-shaped projectiles to which a rotation is imparted about a polar axis, i.e. an axis perpendicular to the plane of the disk and about which the disk is generally rotationally symmetrical, are described, for example, in U.S. Pat. No. 3,646,888.

Such projectiles are fired by a vehicle-mounted weapon having a magazine containing a number of such projectiles which receive their rotation about the polar axis by a rapidly running direct-current motor, the projectiles being brought into driving engagement therewith.

The rotation of the projectile about the polar axis is intended to stabilize the flight path of the projectile, i.e. to impart a generally flat and stable flight to the projectile between the weapon and the target.

One of the drawbacks with such systems is that there is always the danger that successive projectiles may encounter one another in the firing process.

Yet another disadvantage of the system of the patent is the requirement that the weapon be associated with a current source, e.g. that of the vehicle so that the weapon cannot be used in a hand-held manner by an infantry soldier.

When a plurality of weapons for firing such projectiles is provided upon a common vehicle, as is described in this patent, moreover, it is possible to saturate a target area with the disk-shaped projectiles but, when this target area is relatively close, one must reckon with the possibility that fragments of the projectiles or of the target will affect the firing station. This has made such systems less versatile than desired.

In practice it has been found that such weapons systems are not as desirable as might otherwise be expected against small-surface objects, for example armored vehicles such as tanks. Because of the relatively short distance which can be covered with projectiles of the type described, the disclosed weapons system has been found to be of limited utility. Thus it is desirable to provide a weapons system using disk-shaped projectiles which can be used by an individual in the field without dependence upon an energy source and who, in turn, would not be endangered by the use of the weapons system.

OBJECTS OF THE INVENTION

It is the principal object of the present invention to provide a discus-shaped projectile, primarily for use by infantry, which has a higher degree of reliability against small-surface targets than earlier disk projectile systems and, in addition, which can be used effectively against tanks and other armored vehicles.

It is another object of the invention to provide a weapons system utilizing the improved disk-shaped projectile.

SUMMARY OF THE INVENTION

These objects and others which will become apparent hereinafter are attained, in accordance with the present invention, in a discus projectile which comprises a disk shaped body which is rotatable in a fork member about its polar axis and which is provided along its periphery with means, e.g. scoop-shaped recesses or vanes against which gas can be directed to impart a rotation to the disk-shaped body about its polar axis relative to the fork member.

According to the invention, the fork member has an elongated shank portion which is tubular and communicates with a passage for directing a portion of the propellant gases which drive the projectile from the barrel of the weapon against the contoured periphery of the disk to impart the rotation described previously. The rear end of this tubular member is formed with a stabilizing fin system, preferably with swingable fins enabling the tube portion at least to be inserted into the barrel of the weapon and to spring out into their effective positions once the projectile leaves the barrel of the weapon.

According to a feature of the invention, the weapon from which the projectile is fired is a recoil-free firing tube, e.g. of the bazooka or "Panzerfaust" type adapted to be held on the shoulder of the infantryman and not connected with any electrical or other power source inhibiting the mobility of the weapons carrier.

According to yet another feature of the invention, the disk-shaped body is rotatable about a hub mounted between the arms of the fork and carrying a shaped charge adapted to direct its penetrating force along the polar axis either upwardly or downwardly depending upon the intent of the weapons carrier.

The tube may be formed with an additional passage communicating another portion of the propellant gas into the region of the disk so that this additional portion of gas functions as a gas bearing promoting free rotation of the disk.

The end of the tube may be provided with a gas director formed with the aforementioned passages and having a common inlet for the latter. This gas director is provided in the region of the fork member between the upper and lower arms thereof and the inlet is open axially towards the tube while two passages of this gas director are trained generally perpendicularly against the scoop or vane surfaces of the disk.

According to still another feature of the invention, the projectile is substantially symmetrical about the longitudinal axis of the tube which is perpendicular to the polar axis of the disk.

BRIEF DESCRIPTION OF THE DRAWING

The above and other objects, features and advantages of the present invention will become more readily apparent in the following description, reference being made to the accompanying drawing in which.

SPECIFIC DESCRIPTION

Figure 2:
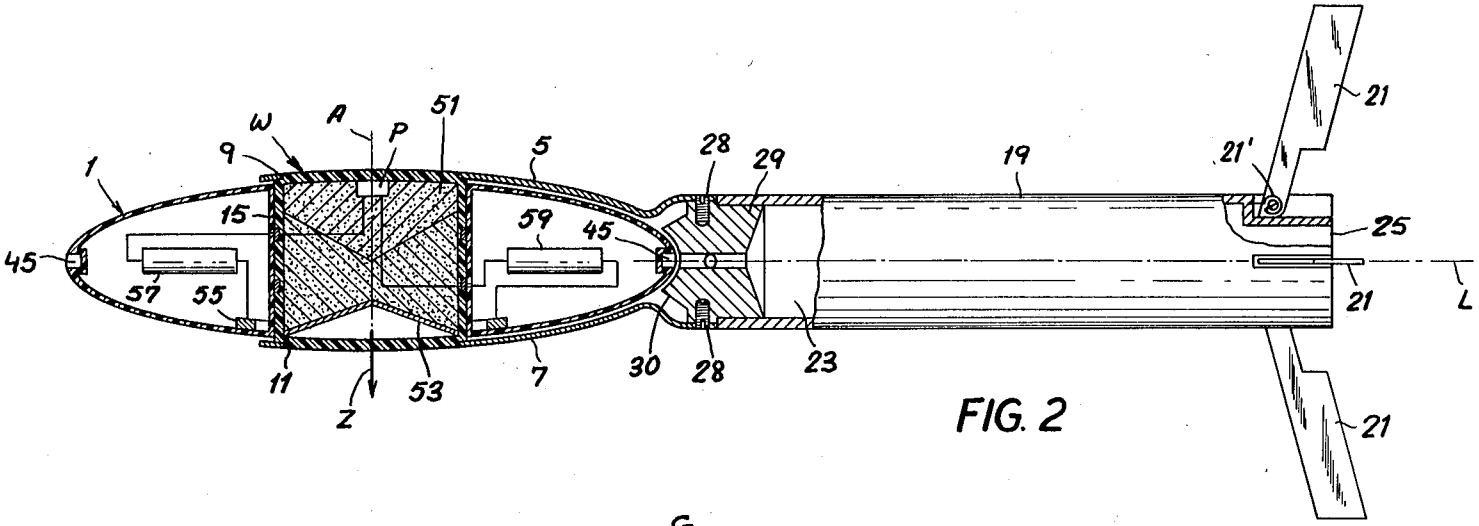
FIG. 2 is a cross-sectional view taken along the line II—II of FIG. 1.
Figure 1:
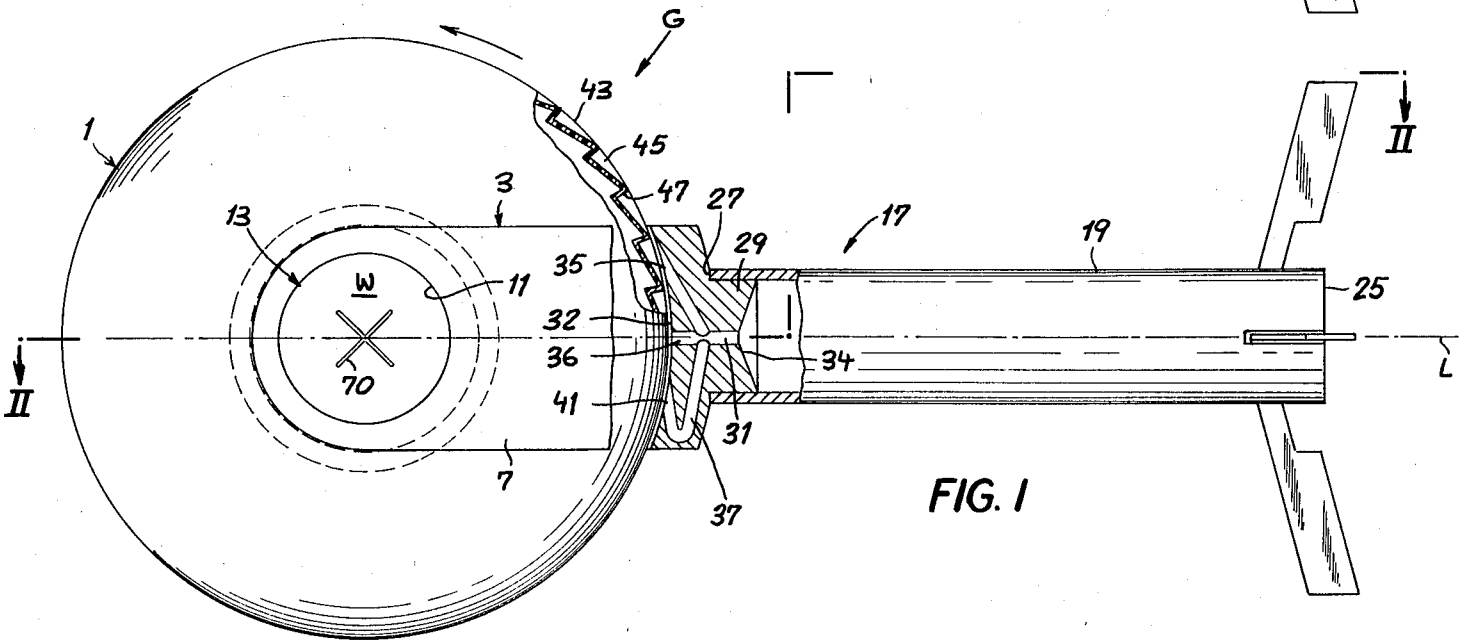
FIG. 1 is a plan view of a discus-shaped projectile in accordance with the present invention, partly broken away.

FIGS. 1 and 2 show a projectile G which comprises a discus-shaped body 1 having a central portion 13, a fork 3 and a fin-stabilizing system 17 including a tube 19 which can contain the charge or propellant for the projectiles.

The central body 13 has a central axis A and is substantially circularly cylindrical, being fixed in an eye 9 of an upper member or arm 5 and in an eye 11 of the lower member 7 of the fork 3.

The central portion 13 contains the effective structure W of the projectile, namely, a shaped explosive charge provided with a primer P.

In the journaling region 15 the disk-shaped body 1 is rotatable about the central body 13 and is provided with slip rings so that the primer P can be fired.

In a transition region 27 between the stabilizing system 17 and the fork 3, the stabilizing system is connected with the fork. Between the two there is provided a gas conductor or director 29 which is disposed between the upper and lower arms 5 and 7 of the fork and is threaded in place at 28.

The gas director 29 terminates between the arms 5 and 7 in a boss 30 closely juxtaposed with the periphery of the disk.

The opposite end of the gas director, shown at 34, receives the tube 19 of the stabilizing system 17.

The gas director has a central bore 31 which communicates with a first branch 33 and a second branch 37, the branches 33 and 37 opening at 35 and 41, respectively, along the periphery 32 of the disk in a reaction region.

An inner chamber 23 of the tube 19 has tail opening 25 through which the propellant gases emerge, and communicates with the central bore 31 at 34.

In the region of the opening 25, the tube 19 has outwardly swingable fins 21 controlled by respective springs 21′ so that, as the projectile leaves the barrel of the weapon, the fins spring into the position shown in FIGS. 1 and 2.

The discus-shaped body 1 is provided in the region of its periphery with a contour 43 which can be in the form of recesses 45 shown only partly in FIG. 1.

Each of the recesses 45 forms a scoop-shaped surface 47 or vane so that, in the reaction region 32 the gases directed from the mouths 35 and 41 perpendicular to the surface 47 propel the disk 1 in the counterclockwise sense represented at 49 in FIG. 1. The branch 33 can thus run along a tangent to the disk. rectilinearly while the branch 37 must be angularly bent so that its portion 41 is disposed tangentially to the disk.

The effective portion W or hub 13 of the projectile includes a complete shaped hollow charge 51 with the usual point-forming insert 53 disposed along the polar axis of the disk-shaped body 1.

In addition, the disk-shaped body is provided with a fly-by fuze trigger represented at 55 connected to an energy source in the form of a pair of batteries 57 and 59, the assembly P, 55, 57, 59 being connected to the slip rings of the hub by brushes in the disk so that, as the projectile transits the region of the target, the primer will be ignited and the explosive force applied in the direction of arrow Z in accordance with armor-piercing shaped-charge principles.

Figure 3:
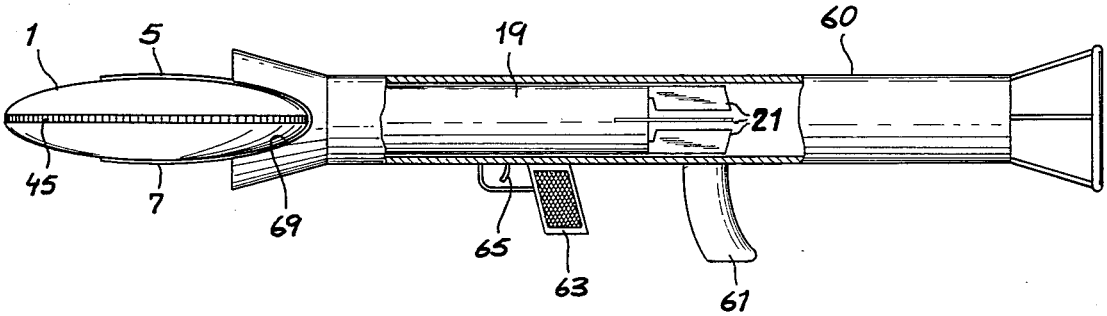
FIG. 3 is a side-elevational view of a weapons system into which a projectile has been inserted for firing and including a recoilless tube.
Figure 4:
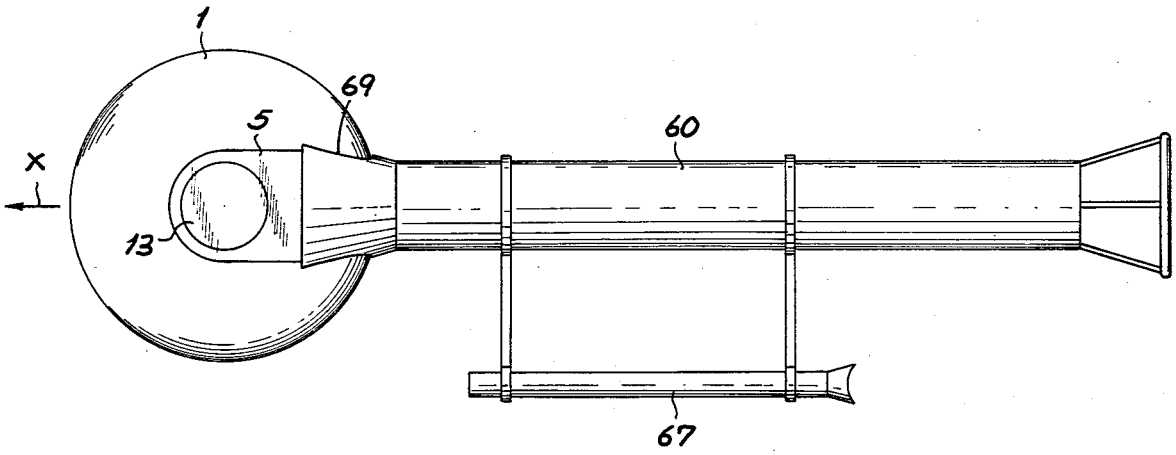
FIG. 4 is a plan view of this weapons system.

As has already been mentioned, the projectile shown in FIGS. 1 and 2 is fired from a recoilless barrel 60 of the so-called Panzerfaust or bazooka type as shown in FIGS. 3 and 4. In these Figures, in which the weapon has been shown only diagrammatically, the shoulder piece 61 of the firing tube is disposed behind a grip 63 and the trigger 65, the projectile being fired as conventional bazooka shells.

A sight tube 67 may be disposed along the barrel 60 as well. The weapons system shown in FIGS. 3 and 4 can thus be carried by an infantryman alone and fired without assistance.

Upon firing, after the projectile has been inserted in the barrel with the fins 21 in their collapsed state, the propellant gases fill the interior 23 of the tube 19 and accelerate the projectile axially in the direction of arrow X (FIG. 4).

A small portion of the propellant gas flows through the central bore 31 in the frustoconical surface 34 which takes the reaction force of the propellant to displace the projectile, and through a central passage 36 thereof to form a gas bearing which relieves the fork 3 from a portion of the accelerating force.

Additional small portions of the propellant gas are fed through the branches 33 and 37 and are expelled from the mouths 35 and 41 in the reaction region against the vanes 47 on the periphery of the disk.

The disk is thus set in rotation about the polar axis A in the counterclockwise sense represented by arrow 49, thereby imparting excellent flight and positional stability to the projectile on its trajectory from the weapon 60 to the target.

Upon emerging from the barrel, the fins 21 spring into their erect positions shown in FIGS. 1 and 2 for directional stability as well.

During its flight and upon encountering the target, the disk-shaped body 1 lies predominantly horizontally with the axis A vertical. The firing tube can be provided with an element or formation generally represented by the slot 69 to ensure that, upon insertion of the projectile, the disk-shaped body will have a horizontal position and its axis will be vertical. Thus this element or formation is a positioning element cooperating with a vertical or horizontal reference edge or the like of the projectile.

The sight tube 67 facilitates monitoring the path of the projectile and can be positioned to target the projectile upon any desired object.

Since the outer shapes of the upper and lower sides of the projectile are the same, i.e. the projectile is symmetrical about the longitudinal axis L and the disk is symmetrical about the vertical axis A, the underside of the projectile may be embossed with indicia, e.g. an "X" as shown at 70 in FIG. 1 so that the effective direction of the charge represented by the arrow Z can be established by the weapons bearer in the field even at night.

This is important because the choice of the direction of the arrow Z as the projectile encounters the target has been found to be important for effective destruction thereof.

For example, when the projectile is to be fired against the turret or engine compartment of a tank, the projectile generally is directed to overfly the tank with arrow Z turned downwardly.

When an attack is desired upon the relatively weak underside of the tank, arrow Z should be directly upwardly. In both cases, the projectile can be directed against portions of the tank in which the armoring is relatively meager. The marking 70, therefore, should not only be visible but should be able to be sensed by the user in the field even under dark conditions.

We claim:

1. A weapons system, especially for foot attack upon armored vehicles, comprising a discus-shaped projectile, said projectile comprising:

a fork having an upper arm and a lower arm;

a stabilizer connected to said fork and including a tube having a longitudinal axis;

an explosive charge carried by said fork;

a disk-shaped body rotatable between the arms of said fork; and means for directing a portion of propellant gases from said tube against said body for rotating said body to stabilize the projectile along its flight toward a target.

2. The system defined in claim 1 wherein said stabilizer comprises a plurality of fins at an end of said tube remote from said fork, and means enabling the displacement of said fins from a collapsed position wherein said fins are receivable in the barrel of the weapon into an extended position wherein said fins provide directional stability for said projectile.

3. The system defined in claim 2 wherein said barrel forms a firing tube of a recoilless weapon.

4. The system defined in claim 2 wherein said disk-shaped body is provided along its periphery with vanes, and the means for directing a portion of propellant gas against said disk-shaped body comprises at least one opening trained upon said vanes for imparting rotation to the disk-shaped body.

5. The system defined in claim 4, further comprising a cylindrical hub received between the arms of said fork and receiving said charge, said disk-shaped body being rotatable around said hub.

6. The system defined in claim 5 wherein a gas director is formed at a transition region between said tube and said fork, said gas director having an axial inlet opening into the interior of said tube and a plurality of passages connected to said inlet including the opening directing propellant gas against said vanes.

7. The system defined in claim 6 wherein said gas director opens between said arms and includes a passage directed at said disk-shaped body for forming a gas bearing therewith.

8. The system defined in claim 7 wherein said fins swing outwardly upon emergence from said barrel.

9. The system defined in claim 8 wherein said projectile is substantially symmetrical with respect to a plane through the longitudinal axis of said tube and perpendicular to the polar axis of said disk.

10. The system defined in claim 9 wherein said disk is provided with means for firing said charge upon fly-by of the target.

* * * * *